US007429217B1

(12) United States Patent
Lawrence

(10) Patent No.: US 7,429,217 B1
(45) Date of Patent: Sep. 30, 2008

(54) CUE STROKE PRACTICE AID

(76) Inventor: David E. Lawrence, 320 Sunny Acres Dr., Cincinnati, OH (US) 45255-4876

( * ) Notice: Subject to any disclaimer, the term of this patent is extended or adjusted under 35 U.S.C. 154(b) by 128 days.

(21) Appl. No.: 11/655,954

(22) Filed: Jan. 22, 2007

(51) Int. Cl.
*A63D 15/00* (2006.01)

(52) U.S. Cl. ..... 473/2; 473/48

(58) Field of Classification Search ..... 473/2, 473/45, 48, 282, 457, 558, 559, 564
See application file for complete search history.

(56) References Cited

U.S. PATENT DOCUMENTS

| | | | |
|---|---|---|---|
| 2,708,577 | A | 5/1955 | Bunka |
| 3,851,876 | A | 12/1974 | Baker |
| D312,290 | S | 11/1990 | Rodriguez |
| 5,125,652 | A | 6/1992 | Davis |
| 5,238,457 | A | 8/1993 | Triplett |
| 5,275,398 | A | 1/1994 | Compton |
| 6,132,319 | A | 10/2000 | Schluter |
| 6,267,685 | B1 | 7/2001 | Cannon |
| D453,364 | S | 2/2002 | Brothers |
| 6,746,336 | B1 | 6/2004 | Brant et al. |
| 2006/0189397 | A1 | 8/2006 | Tucker |

*Primary Examiner*—Mitra Aryanpour
(74) *Attorney, Agent, or Firm*—Charles R. Wilson

(57) ABSTRACT

A cue stroke practice aid is used by a billiards player to improve the player's cue stroke by repetitiously practicing the stroke at varying skill levels until a consistent stroke is developed. The practice aid comprises an elongated housing with first and second openings at opposed ends. A slide assembly is positioned in the elongated housing. The slide assembly includes a shaft, equi-spaced rails extending axially from the shaft, cue guide arms and an adjusting knob. The adjusting knob is used to move the rails laterally within the housing. This has the effect of causing cue guide arms to radially expand or contract from the axis shaft to form a tubular cavity of a desired cross dimension. The opening defined by tips of the cue guide fingers provides a target for the billiards player to practice a stroke at a selected cross dimension according to an attainable skill level.

20 Claims, 7 Drawing Sheets

CUE STROKE PRACTICE AID

FIELD OF THE INVENTION

This invention relates to a cue stroke practice aid for a billiards player. More particularly, the invention relates to a practice aid whereby the billiards player selects the cross dimension of a horizontally disposed tubular chamber according to a skill level to repetitiously practice a cue stroke.

BACKGROUND OF THE INVENTION

Billiards is a game which has been enjoyed by many people for many years. It can be enjoyed at home or in a social setting such as a pool hall. It is primarily a recreational game participated in by players of all skill levels. It can be played professionally as well.

Regardless of the billiards player's skill level, the player's competitive nature drives the player to want to achieve a higher level. Playing the game for extensive time periods can be beneficial. At some point, though, the billiards player must do more. It is all too common that the player reaches a certain skill level and just cannot go beyond that level regardless of how often the game is played.

Most billiards players are self-taught. Some players may benefit from the advice of an onlooker or perhaps from reading an instructional manual on the subject. Various equipment aids have been developed and suggested for improving one's billiards game. U.S. Pat. Nos. 3,851,876, 5,238,457, 5,275,398, 6,267,685, and 6,746,336 all disclose products for use while playing the game. They primarily aid in properly holding or aligning the cue prior to hitting a cue ball. U.S. Pat. Nos. 2,708,577, 5,125,652, 6,132,319, U.S. Publication No. 2006/0189397A1, and U.S. Design Pat. No. DES 312,290 disclose practice aids. They primarily provide a means for the player to develop a better stroke. It is well known that the first step in attaining a high skill level is to develop a cue stroke which is level and which precisely strikes the cue ball at a desired spot. The known practice aids appear either too expensive for the average player or too cumbersome to use. Also, none accommodate differing skill levels.

In accord with a need, there has been developed a practice aid for billiards players. The practice aid is economical to produce, easy to understand, effortless to use, and conducive to creating a repetitive stroke. Most importantly, it can be used by players of different skill levels with means for incremental adjustments until cue stroke perfection has been consistently achieved.

SUMMARY OF THE INVENTION

A cue stroke practice aid is designed for use by billiards players of different skill levels to use and continually improve the player's cue stroke. The device comprises an elongated housing with a slide assembly positioned within it. The slide assembly is adjustable to create a horizontally disposed tubular cavity of a desired cross dimension. The elongated housing has a first opening at one end and a second opening at an opposed end. The slide assembly includes a shaft. A first end of the shaft extends at least partially through the first opening of the elongated housing. An adjusting knob is mounted on that end of the shaft. A second end of the shaft has a set of substantially equi-spaced rails extending axially. The slide assembly also has a set of cue guide arms, each arm movably mounted between two of the rails. A set of travel pins extend through transverse pinholes in adjacent rails and through directional travel slots in the cue guide arms which are positioned therebetween. Cue guide fingers extend longitudinally from a free end of each cue guide arm through the second opening in the elongated housing. The adjusting knob is turned to cause the shaft and its associated rails to slide laterally within the elongated housing. This in turn causes the cue guide arms to move inwardly or outwardly as they are forced to travel along the travel pins until the desired cross dimension defined by the cue guide fingers and arms is created for that particular player. The rails and cue guide arms form the tubular cavity which extends from the second opening of the elongated housing inwardly. The tubular cavity is used by the billiards player to repetitiously practice the player's cue stroke at the desired selected cross dimension.

DETAILED DESCRIPTION OF THE INVENTION

The cue stroke practice aid of the invention is described in detail in the following paragraphs and with reference to the drawings. The practice aid is primarily used by placing it on a billiards table and the player repetitiously practicing the cue stroke until a consistently level stroke has been attained. A consistent forward thrust and follow-through of the cue is the objective. The practice aid can as well be placed and used on any other flat top surface, such as a desk or table of approximately the same height as a billiards table.

Figure 1:
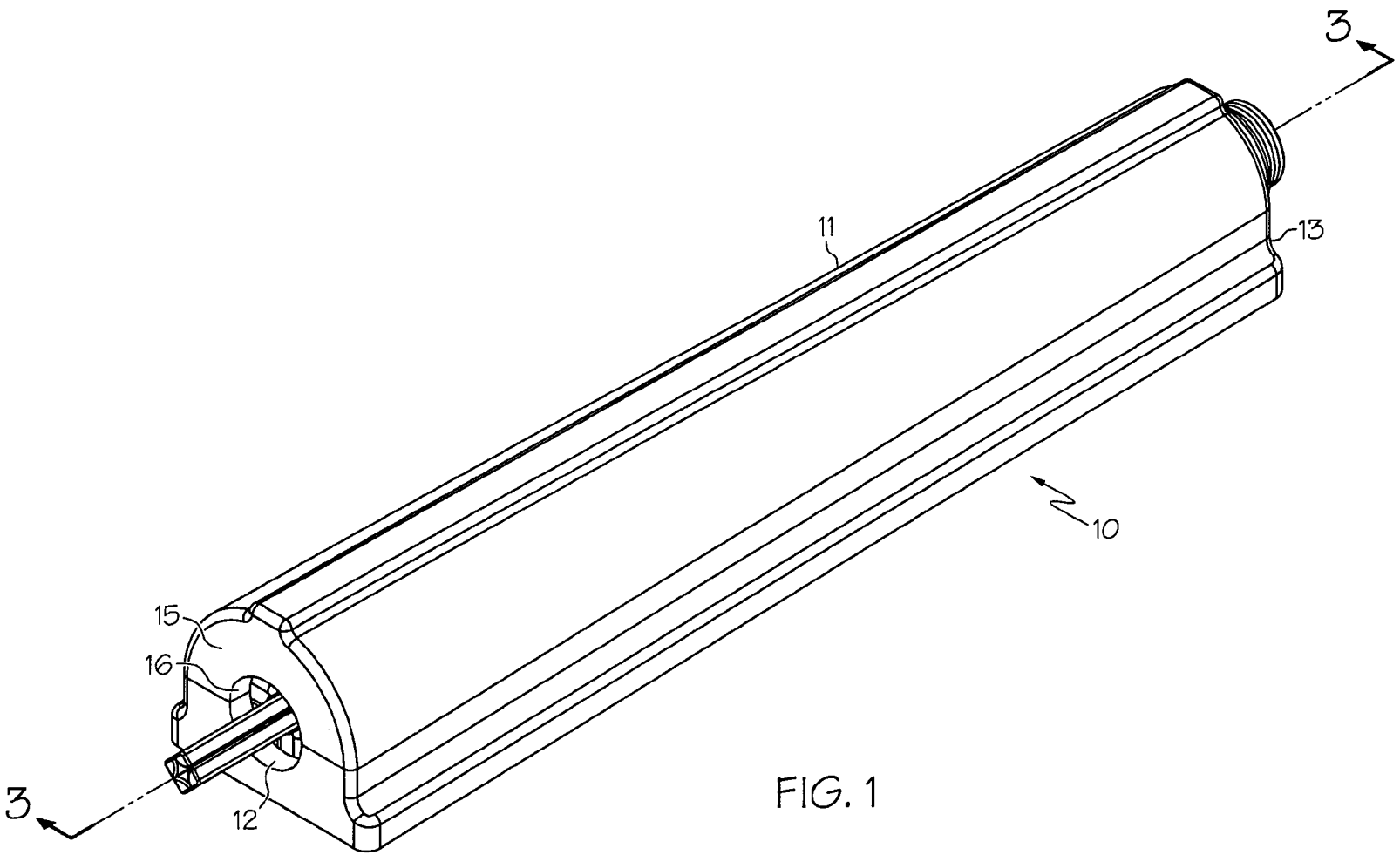
FIG. 1 is a view in perspective of the cue stroke practice aid of the invention adjusted to show cue guide fingers in a fully closed position.
Figure 2:
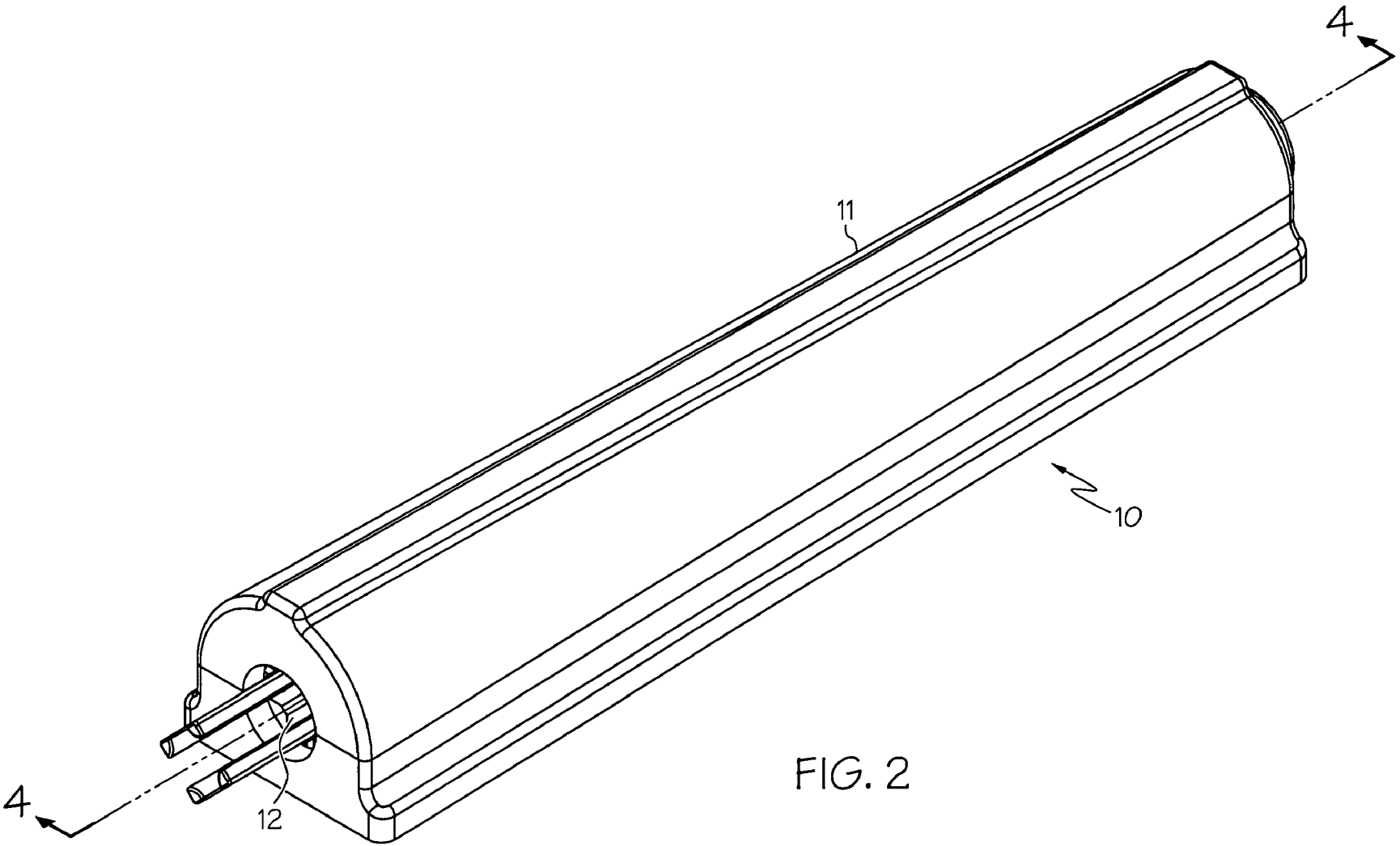
FIG. 2 is a view in perspective of the cue stroke practice aid of FIG. 1 adjusted to show the cue guide fingers in a fully open position.
Figure 3:
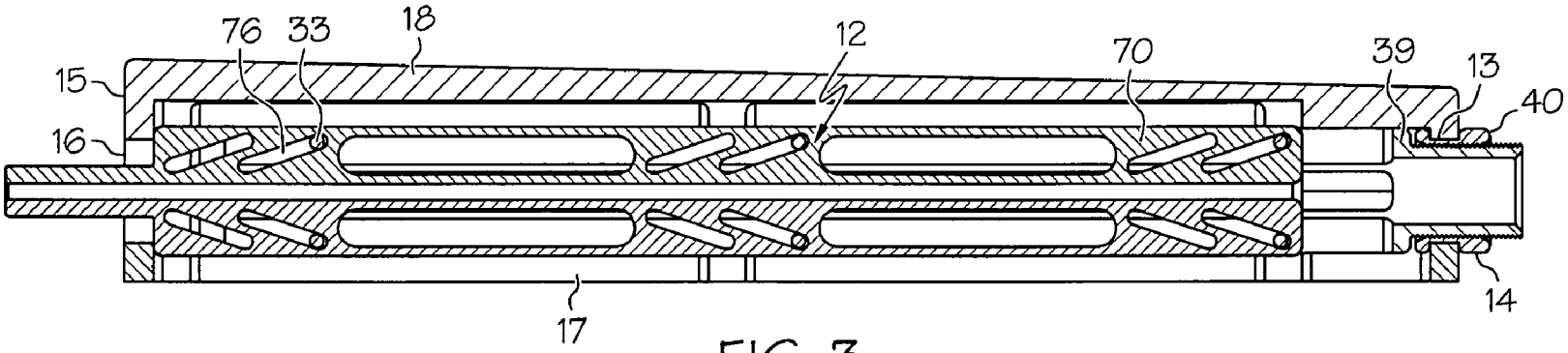
FIG. 3 is a sectional view of the cue stroke practice aid of FIG. 1 taken along line 3-3.
Figure 4:
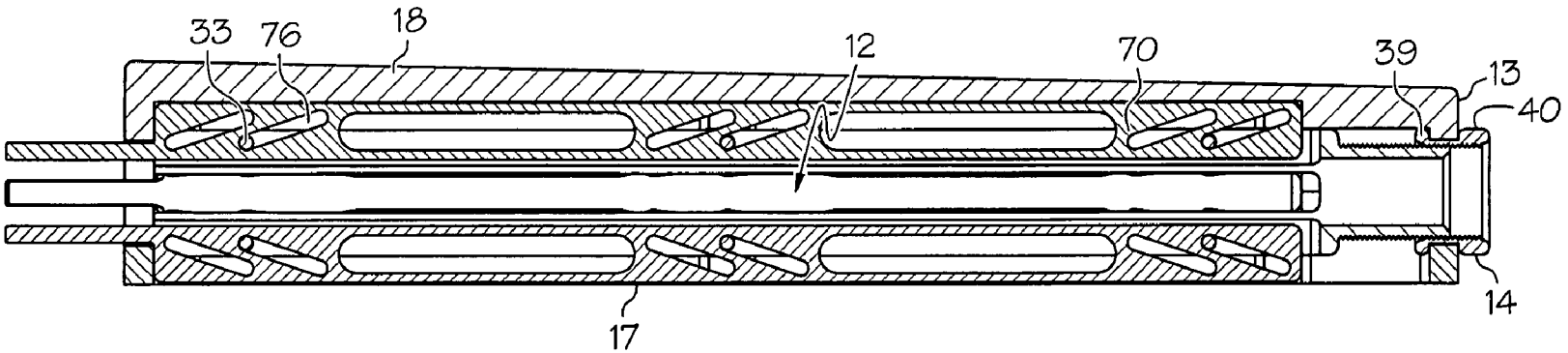
FIG. 4 is a sectional view of the cue stroke practice aid of FIG. 2 taken along line 4-4.
Figure 5:
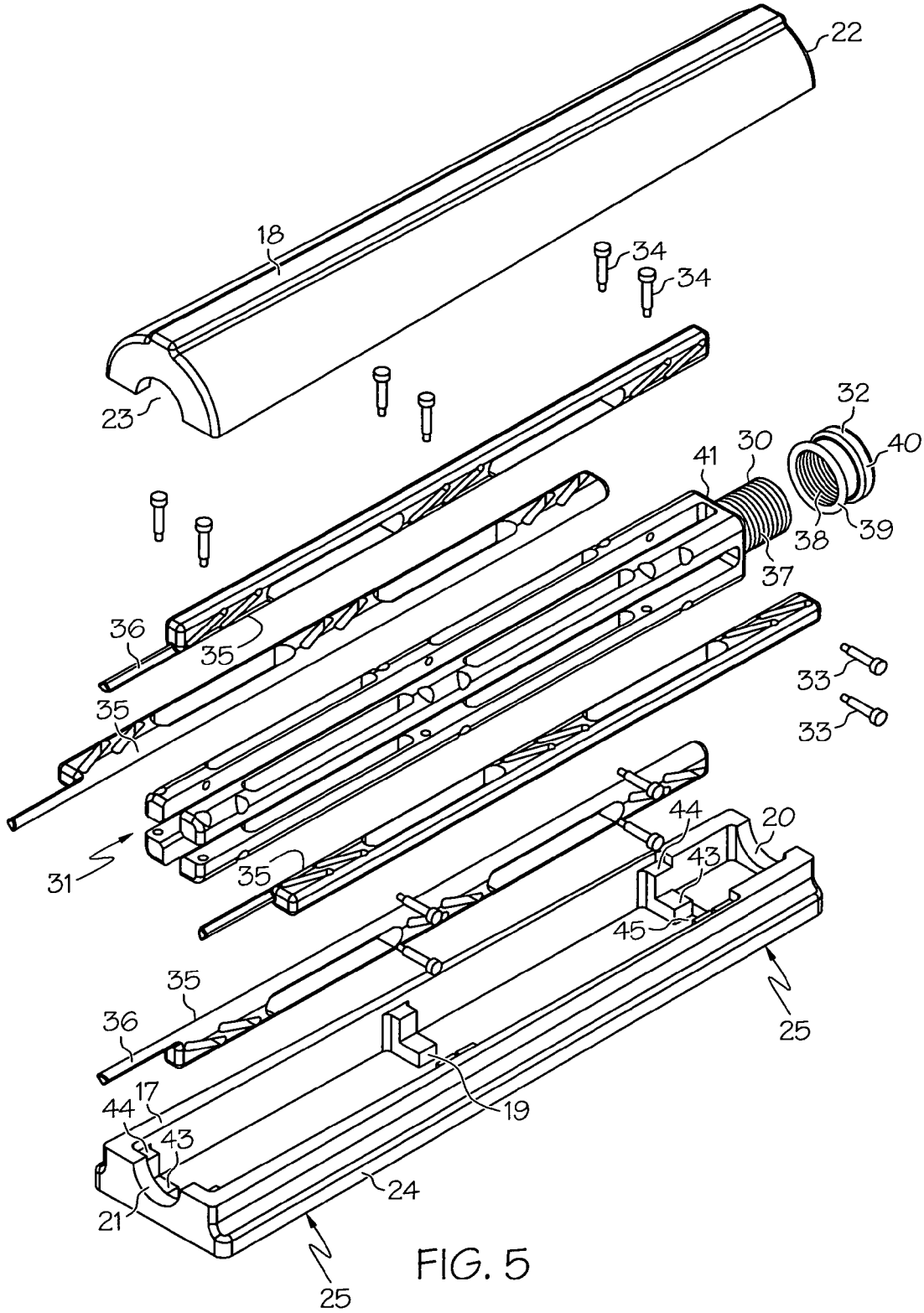
FIG. 5 is an exploded view in perspective of the cue stroke practice aid of FIG. 1.
Figure 6:
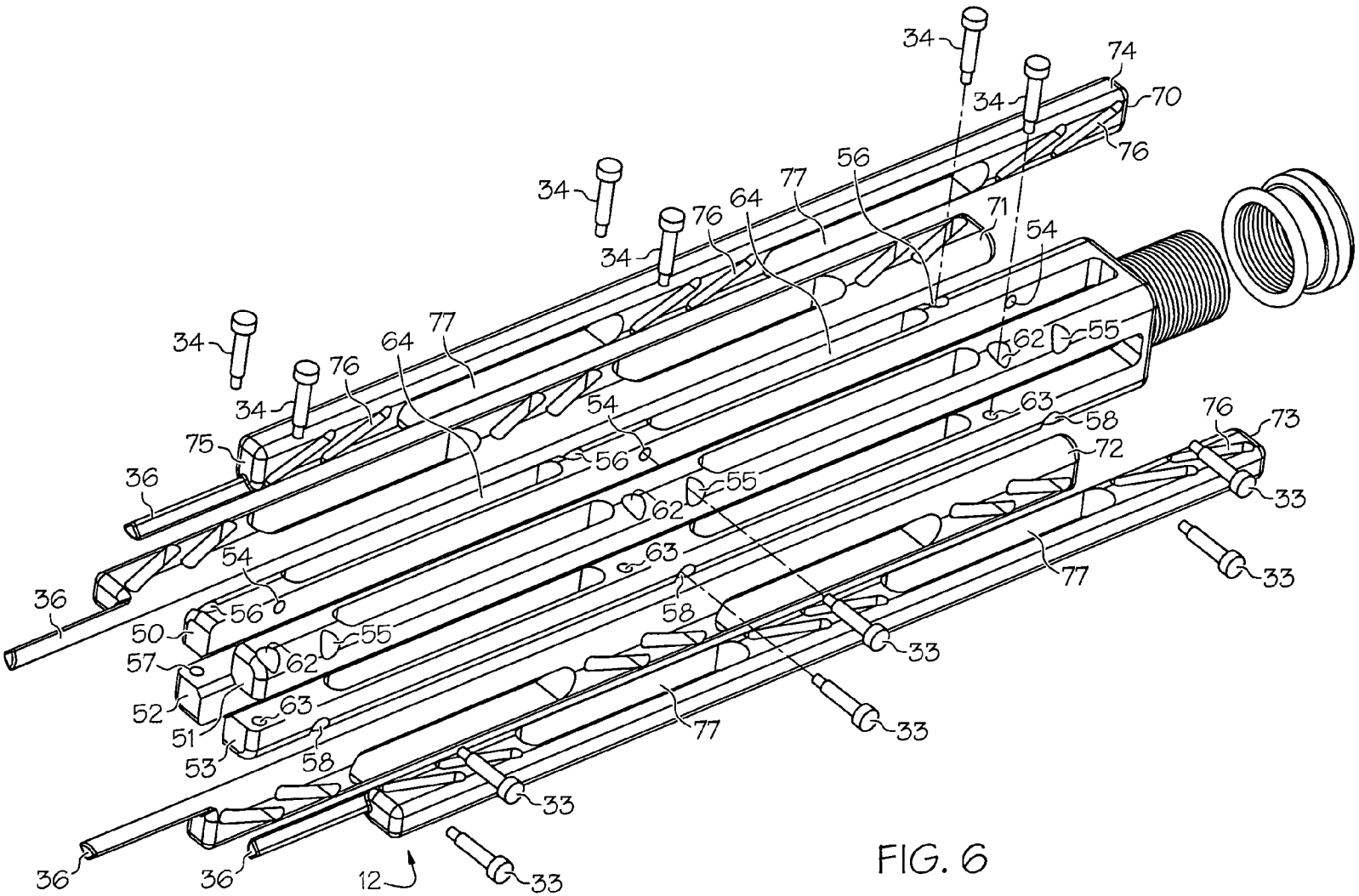
FIG. 6 is an exploded view in perspective of a slide assembly of the cue stroke practice aid of FIG. 5 in isolation.

The cue stroke practice aid 10 of the invention comprises an elongated housing 11 and a slide assembly 12. The elongated housing is best seen in FIGS. 1, 2, 3, 4, and 5. The slide assembly 12 is best seen in FIGS. 5 and 6, while its mode of operation is best understood with reference to FIGS. 3, 4, 7 and 8.

With reference to FIGS. 1-5, the elongated housing 11 is generally cylindrical-shaped with a flattened bottom. It has a first end 13 with a first opening 14 (evident in FIGS. 3 and 4) and a second end 15 with a second opening 16. As most evident in FIG. 5, the elongated housing 11 has a bottom housing half 17 and a mating top housing half 18. A cavity created by walls of the housing halves within the housings is occupied by the slide assembly 12. A set of slide assembly rests 19 positioned along opposed walls of the bottom housing half 17 are to receive the slide assembly described in detail below. A second set of rests (not seen in FIG. 5) are positioned along opposed walls of the top housing half and are in alignment with the first set of rests. The rests are L-shaped and are permanently attached to or molded into the housing walls.

Arch-shaped openings 20 and 21 in the bottom housing half 17 mate with arch-shaped openings 22 and 23 in the top housing half 18 to create the first opening 14 and the second opening 16 in the elongated housing 11. The two openings are opposed one another.

The elongated housing 11 has two halves to allow assembling of the slide assembly into the housing's cavity. The housing halves 17 and 18 preferably are made of a molded plastic. They are attached together once the slide assembly is properly positioned. While not shown, screws, bolts, double sided adhesive tape or other common attaching means are used to permanently attach together the two housing halves. Preferably, the bottom housing half 17 further has a metal plate 24 attached to its underside to add weight to the cue stroke practice aid. The metal plate 24 is configured to fit within the outline of the bottom housing half. Further, a set of anti-slide pads 25 are added to the underside of the metal plate to ensure the cue stroke practice aid 10 does not slide while in use.

Figure 7:
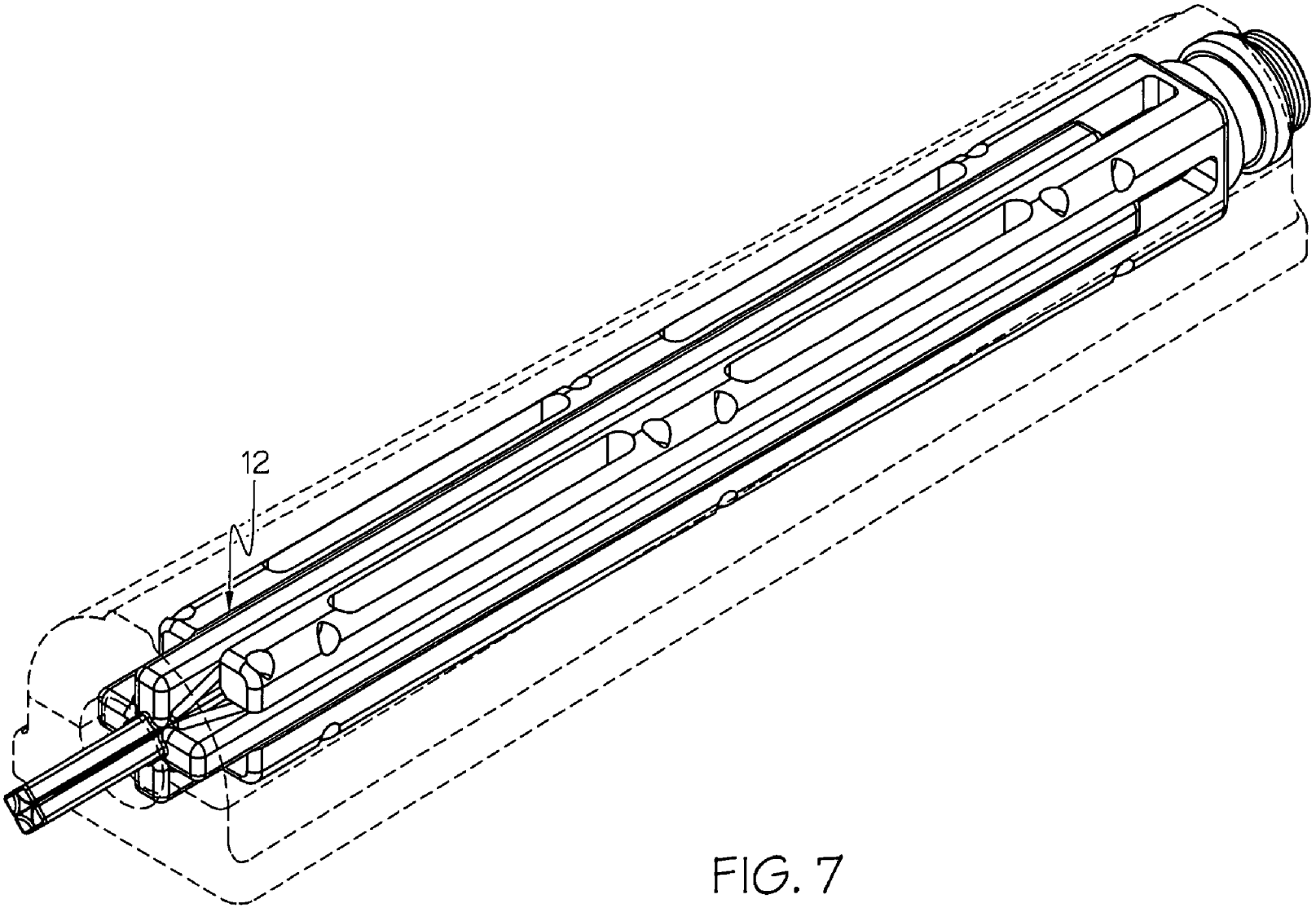
FIG. 7 is a view in perspective showing the slide assembly of the cue stroke practice aid of FIG. 1 in the fully closed position with its housing in phantom.
Figure 8:
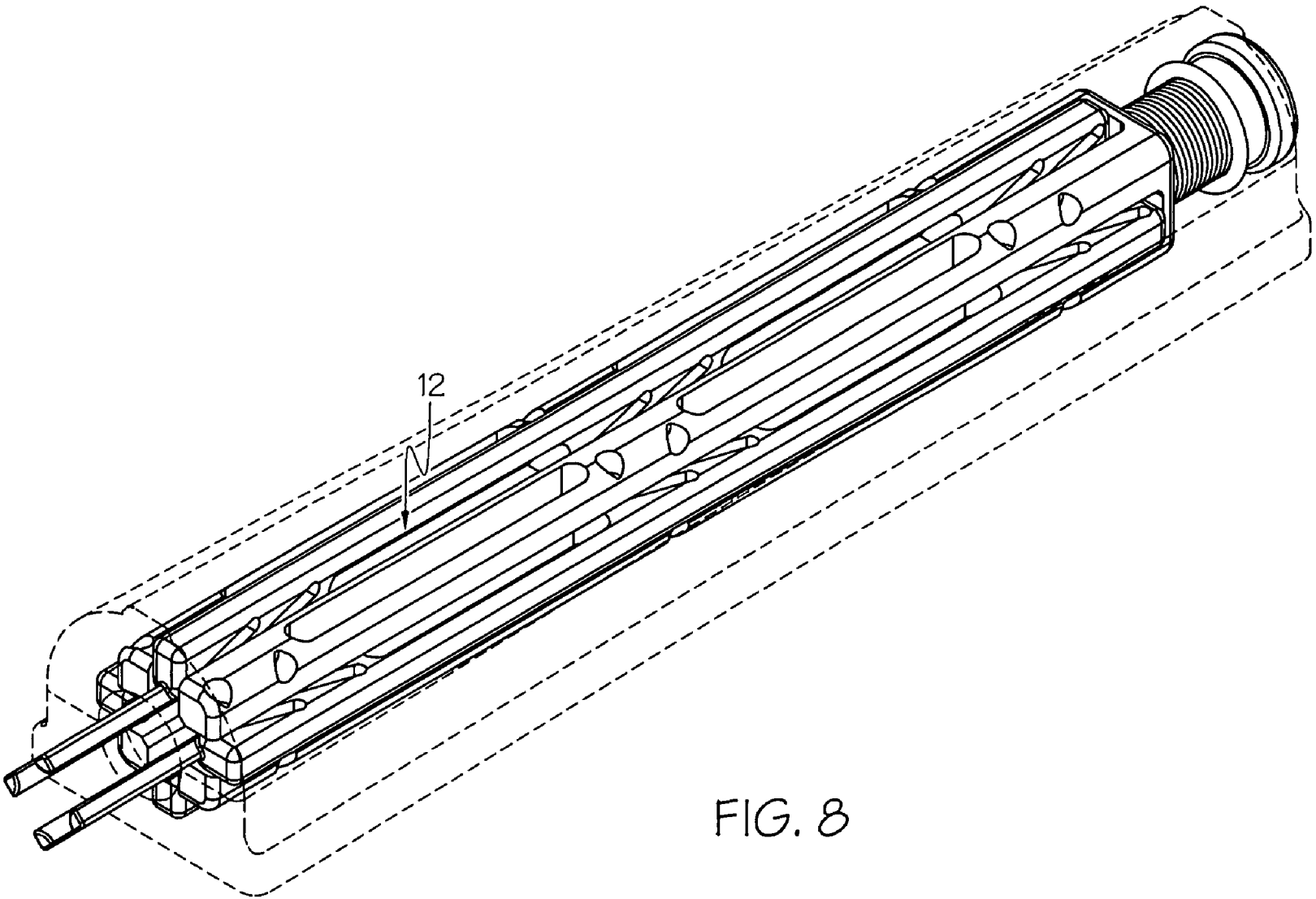
FIG. 8 is a view in perspective showing the slide assembly of the cue stroke practice aid of FIG. 2 in the fully open position with its housing in phantom.

Still with reference to FIG. 5, the slide assembly 12 includes a shaft 30 with an axially extending rail set 31, an adjusting knob 32, horizontally disposed travel pins 33, vertically disposed travel pins 34, and a cue guide arm set 35. Each cue guide arm further has a cue guide finger 36 which extends longitudinally therefrom. The components of the slide assembly 12 are operably associated so as to create a tubular cavity defined by the cue guide arm set 35 and cue guide fingers 36 as they expand as best seen in FIGS. 4 and 8. The cavity is closed as the cue guide arms and fingers contract as best seen in FIGS. 3 and 7. The expansion/contraction is caused by turning the adjusting knob 32 and ultimately forcing the cue guide arm set 35 to travel along a defined path. As apparent to the billiards player and further discussed below, the defined tubular cavity is used to insert a distal end of the cue in a practice stroke. A successful stroke is one in which no contact is made by the cue with the cue guide arms and fingers.

The shaft 30 of the slide assembly 12 has a diameter slightly less than the first opening 14 in the housing 11. A first free end of the shaft extends through the opening and is intended to move back or forth in the opening by turning of the adjusting knob. For this purpose, the shaft 30 has external threads 37 and the adjusting knob has mating internal threads 38. The adjusting knob has an annular shape with a ring-shaped internal stop rib 39 and a ring-shaped external stop rib 40. The two ribs effectively trap the knob in the housing's first opening.

A rail bracket 41 is permanently secured to the second end of the shaft 30 opposite its first end. The rail bracket 41 is flat and mounted transversely to the shaft's longitudinal axis. It serves to hold ends of the rails outside the shaft's cylindrical 5 surface. Extending axially from the shaft 30 are four substantially equi-spaced rails forming the rail set 31. Collectively, the rails of the rail set 31 form a box-like structure with the rails parallel to one another and each rail having a gap between it and an adjacent rail. The rails extend to near the full length of the housing's cavity. Each of the rails is operatively associated with both a horizontally disposed rail and with a vertically disposed rail through the travel pins 33 and 34. For this purpose, each of the rails in the rail set 31 has at least two spaced transverse horizontal pinholes and at least two spaced 15 transverse vertical pinholes. The pinholes are aligned with like pinholes in an adjacent rail.

As seen in FIG. 5, the bottom housing half 17 has three sets of slide assembly rests 19. While not seen, the top housing half 18 has identically positioned and configured slide assembly rests. Each rest has an innermost ledge 43 which receives a rail of the rail set 31. Also, each rest 19 has an outermost ledge 44 which receives a cue guide arm 35. A notch 45 between opposed slide assembly rests 19 receives another cue guide arm 35.

Now with more particularity, and with reference to FIG. 6, the rail set includes rails 50, 51, 52, and 53. Thus, rail 50 has three horizontal pinholes 54 aligned with three horizontal pinholes 55 in horizontally disposed adjacent rail 51. Rail 50 further has three vertical pinholes 56 aligned with three vertical pinholes 57 in vertically disposed adjacent rail 52. Each set of aligned horizontal pinholes 54 and 55 holds a travel pin 33 and each set of aligned vertical pinholes 56 and 57 holds a travel pin 34. In a similar fashion, rail 53 has three horizontal pinholes 58 aligned with horizontal pinholes (not shown) in horizontally disposed adjacent rail 52. Further, vertically disposed adjacent rails 51 and 53 each has three vertical pinholes 62 and 63, respectively, in alignment. Elongated holes 64 in each of the rails are for material savings purposes.

The travel pins 33 extend between aligned horizontal pinholes and the travel pins 34 extend between aligned vertical pinholes in the rails 50-53. The travel pins are positioned in the respective aligned pinholes and permanently secured in place.

Still with reference to FIG. 6, the cue guide arm set 35 of the slide assembly includes cue guide arms 70, 71, 72, and 73, each with a first end 74 and an opposed second end 75. They are identical in structure, though cue guide arms 70 and 72 are vertically disposed with arm 70 positioned between rails 50 and 51 and arm 72 positioned between rails 52 and 53. Cue guide arms 71 and 73 are horizontally disposed with arm 71 positioned between rails 50 and 52 and arm 73 positioned between rails 51 and 53. Each cue guide arm is elongated with a rectangular-shaped cross section when viewed at a right angle to its longitudinal axis.

Each cue guide arm has a length less than the length of the rails and has a width about the same as the distance between the rails. They are trapped in position by the cavity walls of the housing halves and made to expand or contract by the aforedescribed travel pins as the slide assembly's shaft and rails are forced to move laterally. For this purpose, each cue guide arm has at least two spaced directional travel slots 76 positioned in it to receive one of the travel pins. The travel slots 76 are angled from the longitudinal axis of the cue guide arm and extend fully therethrough. Each travel slot extends from near an innermost surface of the cue guide arm when positioned between rails back towards the cue guide arm's first end 74 at an angle of from about thirty degrees to about sixty degrees. The cue guide arms 70-73 are each shown with six travel slots 76, though only three are used with the cue stroke practice aid 10 illustrated. The extra three travel slots in each cue guide arm can receive a travel pin for enhanced smoothness in operation, but are not necessary. Elongated holes 77 are provided in the cue guide arms for weight reduction and raw material savings only.

For illustration purposes, and still with reference to FIG. 6, the cue guide arm 70, positioned between rails 50 and 51 has travel pins 33 extending from rail 51, through the cue guide arm travel slots 76, and into rail 50. As seen in FIG. 4, the cue guide arm 70 rides along its associated set of travel pins to expand as the slide assembly slides inwardly through the housing's first opening and, as seen in FIG. 3, to contract as the slide assembly slides outwardly through the housing's first opening. This expansion/contraction results from the cue guide arms being forced by its angled slots to ride along its associated travel pins.

Again with reference to FIG. 6, the cue guide arms 70-73 all have cue guide fingers 36 running longitudinally from the second end 75 sufficiently long for extending out through the second opening in the housing 11. The cue guide fingers are identical in structure and function. The length of the cue guide arms restrict their movement to within the tubular cavity of the housing. The fingers, extending out through the second opening 16, are in full view of the billiards player and as such serves as a visual target for practicing a cue stroke. Each finger is about one inch to two inches long. Preferably, and as best seen in FIGS. 7 and 8, the guide fingers are rounded on an inside surface nearest the slide assembly's center axis to better accommodate an errant cue stroke.

The individual components of the cue stroke practice aid of the invention are preferably all made of plastic. All or selected components of the practice aid can as well be made of wood, metal or any other rigid material.

As an option, the tubular cavity within the elongated housing can have a slight downward slope to better approximate a natural cue stroke. A drop of from about five degrees to about ten degrees from the second end to the first end is preferred. The drop can be achieved best by having the metal plate on the underside of the bottom housing half configured to achieve the desired slope.

In operation, the practice aid of the invention is placed on a flat surface, ideally a billiards table. The adjusting knob is turned to adjust the cross dimension distance between the cue guide arms and fingers. The novice will choose a fully open position to have the greatest distance within which to practice a stroke. The more skilled player will turn the adjusting knob to contract the cue guide arms and fingers to a lesser distance, depending on the player's skill level. As the player's stroke improves, the distance is reduced. Ultimately, the billiards player is able to consistently stroke the cue into the practice aid when set to minimal cue clearance without the cue making contact with the cue guide arms and fingers.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A cue stroke practice aid for billiard players of different skill levels, comprising:

a. an elongated housing having a first opening at one end and a second opening at an opposed end; and b. a slide assembly positioned in the housing, said slide assembly including (i) a shaft having a first end extending at least partially through the first opening in the elongated housing, and a second end having four equi-spaced rails extending axially therefrom, each said rail having at least two spaced horizontal pinholes and at least two spaced vertical pinholes extending therethrough, (ii) an adjusting knob mounted on the first end of the shaft so as to be outside the elongated housing, (iii) a travel pin mounted in each of the pinholes of the rail, and (iv) a set of cue guide arms, each said cue guide arm movably mounted between two of the rails and having at least two travel pin directional travel slots, whereby the billiards player turns the adjusting knob to create a cross dimension between the cue guide arms according to a desired skill level and practices stroking a cue within the cue guide arms until a stroke consistently can be taken without making contact.

2. The cue stroke practice aid of claim 1 wherein the elongated housing includes two housing halves attached together.

3. The cue stroke practice aid of claim 2 wherein the elongated housing includes a trough-shaped bottom housing half with elongated walls and transverse end walls forming a cavity therewithin and with a semi-circle cut in one end and a semi-circle cut in an opposed end, a mating inverted trough-shaped top housing half with elongated walls and transverse end walls forming a cavity therewith and with a semi-circle cut in one end and a semi-circle cut in an opposed end whereby the semi-circle cuts in each end form the first opening and the second opening in the elongated housing when the bottom and top housing halves are mated, and attachment means for permanently holding the bottom housing half and top housing half together.

4. The cue stroke practice aid of claim 3 wherein the cavity of the bottom housing half has at least two slide assembly rests spaced therealong and the cavity of the top housing half has at least two slide assembly rests spaced therealong and aligned with the slide assembly rests of the bottom housing half for suspending the slide assembly within the housing.

5. The cue stroke practice aid of claim 4 wherein the shaft of the slide assembly has external threads and the adjusting knob mounted thereon has internal threads whereby turning the adjusting knob causes the shaft and its rails to laterally slide.

6. The cue stroke practice aid of claim 5 wherein the shaft of the slide assembly further has a rail bracket mounted at its terminus and the equi-spaced rails are mounted at terminuses thereto at points outside the perimeter of the shaft.

7. The cue stroke practice aid of claim 6 wherein each of the equi-spaced rails of the slide assembly has three substantially equi-spaced transverse horizontally disposed travel pinholes and further has three substantially equi-spaced transverse vertically disposed travel pinholes.

8. The cue stroke practice aid of claim 7 wherein the adjusting knob mounted on the shaft of the slide assembly has an internal annular ring and an external annular ring for trapping the adjusting knob on the elongated housing.

9. The cue stroke practice aid of claim 8 wherein the travel pins each has a length sufficient to extend from one rail to an adjacent rail and is secured in place.

10. The cue stroke practice aid of claim 9 wherein each cue guide arm of the slide assembly has three equi-spaced travel slots.

11. The cue stroke practice aid of claim 10 wherein each cue guide arm further has a slender cue guide finger extending from one end so as to protrude through the second opening of the elongated housing.

12. The cue stroke practice aid of claim 11 wherein the cue guide fingers extending from each cue guide arm of the slide assembly has a smaller cross dimension when viewed transversely to its longitudinal axis than that of the cue guide arm for protruding through the second opening of the elongated housing while restricting movement of the cue guide arms therethrough.

13. The cue stroke practice aid of claim 12 wherein each cue guide arm of the slide assembly has a length about equal to the lengths of the bottom housing half cavity and the top housing half cavity for preventing lateral movement of the cue guide arms within the elongated housing.

14. A cue stroke practice aid for billiard players of different skill levels, comprising:

a. an elongated housing of two housing halves joined together, said elongated housing having a first opening at one end and a second opening at an opposed end; and b. a slide assembly positioned in the housing, said slide assembly including (i) a horizontally disposed externally threaded shaft having a first end extending at least partially through the first opening in the elongated housing, and a second end having a rail bracket attached thereto and having four equi-spaced rails extending axially therefrom, each said rail having three horizontal pinholes extending therethrough and three vertical pinholes extending therethrough, (ii) an internally threaded adjusting knob mounted on the first end of the shaft so as to be outside the elongated housing, (iii) a travel pin mounted in each of the pinholes in the rail, and (iv) four cue guide arms, each said cue guide arm having three substantially equi-spaced angled directional travel slots and further having a slender cue guide finger extending from one end so as to protrude through the second opening of the elongated housing, wherein each cue guide arm is movably mounted between two of the rails by the travel pins, whereby the billiards player turns the adjusting knob to create a cross dimension between the cue guide fingers according to a desired skill level and practices stroking a cue within the cue guide fingers until a stroke consistently is achieved without the cue making contact with the cue guide fingers and cue guide arms.

15. The cue stroke practice aid of claim 14 wherein the elongated housing includes a trough-shaped bottom housing half with elongated walls and transverse end walls forming a cavity therewithin and having at least two slide assembly rests spaced therealong and further having a semi-circle cut in one end and a semi-circle cut in an opposed end, a mating inverted trough-shaped top housing half with elongated walls and transverse end walls forming a cavity therewithin and having at least two slide assembly rests spaced therealong and aligned with the slide assembly rests of the bottom housing half for suspending the slide assembly within the housing and further having a semi-circle cut in one end and a semi-circle cut in an opposed end whereby the semi-circle cuts in each end form the first opening and the second opening in the elongated housing when the bottom and top housing halves are mated, and attachment means for permanently holding the bottom housing half and top housing half together.

16. The cue stroke practice aid of claim 15 wherein the adjusting knob mounted on the shaft of the slide assembly has an internal annular ring and an external annular ring for trapping the adjusting knob on the elongated housing.

17. The cue stroke practice aid of claim 16 wherein the travel pins each has a length sufficient to extend from one rail to an adjacent rail.

18. The cue stroke practice aid of claim 17 wherein each cue guide arm of the slide assembly has a length about equal to the lengths of the bottom housing half cavity and the top housing half cavity for preventing lateral movement of the cue guide arms within the elongated housing.

19. The cue stroke practice aid of claim 18 wherein the cue guide fingers extending from each cue guide arm of the slide assembly has a smaller cross dimension when viewed transversely to its longitudinal axis than that of the cue guide arm for protruding through the second opening of the elongated housing while restricting movement of the cue guide arms therethrough.

20. A cue stroke practice aid for billiard players, comprising:

a. an elongated housing of two housing halves joined together, said elongated housing having a first opening at one end and a second opening at an opposed end wherein the elongated housing includes a trough-shaped bottom housing half with elongated walls and transverse end walls forming a cavity therewithin and having at least two slide assembly rests spaced therealong and further having a semi-circle cut in one end and a semi-circle cut in an opposed end, a mating inverted trough-shaped top housing half with elongated walls and transverse end walls forming a cavity therewithin and having at least two slide assembly rests spaced therealong and aligned with the slide assembly rests of the bottom housing half for suspending the slide assembly within the housing and further having a semi-circle cut in one end and a semi-circle cut in an opposed end whereby the semi-circle cuts in each end form the first opening and the second opening in the elongated housing when the bottom and top housing halves are mated, and attachment means for permanently holding the bottom housing half and top housing half together; and b. a slide assembly positioned on the slide assembly rests within the housing, said slide assembly including (i) a horizontally disposed externally threaded shaft having a first end extending at least partially through the first opening in the elongated housing, and a second end having a rail bracket attached thereto and having four equi-spaced rails extending axially therefrom, each said rail having three horizontal pinholes extending therethrough and three vertical pinholes extending therethrough, (ii) an internally threaded adjusting knob threadingly mounted on the first end of the shaft so as to be outside the elongated housing, said adjusting knob having an internal annular ring and an external annular ring for trapping the adjusting knob on the elongated housing, (iii) a travel pin mounted in each of the pinholes in the rail, each said travel pin having a length sufficient to extend from one rail to an adjacent rail and secured thereto, and (iv) four cue guide arms, each said cue guide arm having three substantially equi-spaced directional travel slots angled at about thirty degrees to about sixty degrees from a longitudinal axis of the cue guide arm and further having a slender cue guide finger extending from one end so as to protrude through the second opening of the elongated housing, wherein each cue guide arm is movably mounted between two of the rails by the travel pins, whereby the billiards player practices stroking a cue within the cue guide fingers and arms.

* * * * *